US006538183B2

(12) United States Patent
Verd

(10) Patent No.: US 6,538,183 B2
(45) Date of Patent: Mar. 25, 2003

(54) COMPOSITE STRINGED MUSICAL INSTRUMENT, AND METHOD OF MAKING THE SAME

(76) Inventor: Frederick J. Verd, 10654 Keith St., Santee, CA (US) 92071

( * ) Notice: Subject to any disclaimer, the term of this patent is extended or adjusted under 35 U.S.C. 154(b) by 0 days.

(21) Appl. No.: 09/779,105

(22) Filed: Feb. 7, 2001

(65) Prior Publication Data

US 2002/0104423 A1 Aug. 8, 2002

Related U.S. Application Data

(60) Provisional application No. 60/180,958, filed on Feb. 8, 2000.

(51) Int. Cl.[7] ..... G10D 3/00

(52) U.S. Cl. ..... 84/291; 84/290

(58) Field of Search ..... 84/291, 290, 314 R, 84/723, 725, 730

(56) References Cited

U.S. PATENT DOCUMENTS

| | | | | | |
|---|---|---|---|---|---|
| 4,084,476 | A | | 4/1978 | Richard | |
| 4,145,948 | A | | 3/1979 | Turner | |
| 4,188,850 | A | | 2/1980 | Kaman | |
| 4,290,336 | A | | 9/1981 | Peavey | |
| 4,313,362 | A | | 2/1982 | Lieber | |
| 4,602,547 | A | * | 7/1986 | Nyack et al. | 84/726 |
| 4,744,280 | A | * | 5/1988 | Ganitano | 84/726 |
| 4,846,038 | A | | 7/1989 | Turner | |
| 4,846,039 | A | | 7/1989 | Mosher | |
| 4,873,807 | A | | 10/1989 | Decker et al. | |
| 4,950,437 | A | | 8/1990 | Lieber | |
| 4,969,381 | A | | 11/1990 | Decker et al. | |
| 5,071,506 | A | | 12/1991 | Nelson et al. | |
| 5,125,312 | A | * | 6/1992 | Fishman et al. | 84/291 |
| 5,198,173 | A | | 3/1993 | Terzian et al. | |
| 5,333,527 | A | | 8/1994 | Janes et al. | |
| 5,418,051 | A | * | 5/1995 | Caldwell | 442/61 |
| 5,537,906 | A | * | 7/1996 | Steinberger | 84/291 |
| 5,895,872 | A | | 4/1999 | Chase | |
| 5,905,219 | A | | 5/1999 | Westheimer | |
| 5,955,688 | A | | 9/1999 | Cook | |
| 6,087,568 | A | | 7/2000 | Seal | |
| 6,100,458 | A | | 8/2000 | Carrington et al. | |
| 6,107,552 | A | | 8/2000 | Coomar et al. | |

OTHER PUBLICATIONS

Decker, John A., "Graphite Guitar Acoustics 101," http://www.rainsong.com/acc101.htm, Nov. 4, 1999.

* cited by examiner

*Primary Examiner*—Shih-Yung Hsieh
(74) *Attorney, Agent, or Firm*—Janet Elliott; Marianne Fuierer; Steven J. Hultquist

(57) ABSTRACT

Methods of construction for acoustic and electrically amplified stringed musical instruments. The invention further relates to acoustic and electrically amplified stringed musical instruments comprising fiber-reinforced resin composite materials, where the instruments are provided with a sound-damping interior coating.

27 Claims, 7 Drawing Sheets

COMPOSITE STRINGED MUSICAL INSTRUMENT, AND METHOD OF MAKING THE SAME

CROSS-REFERENCE TO RELATED APPLICATIONS

This application claims the benefit of U.S. PROVISIONAL APPLICATION No. 60/180,958, filed Feb. 8, 2000, entitled "Composite Stringed Musical Instrument," of which this is a continuation-in-part and which application is incorporated herein by reference in its entirety.

BACKGROUND OF THE INVENTION

1. Field of the Invention

The invention relates generally to methods of construction for acoustic and electrically amplified stringed musical instruments. The invention further relates to acoustic and electrically amplified stringed musical instruments comprising fiber-reinforced resin composite materials, where the instruments are provided with a frequency-damping interior coating.

2. Description of the Related Art

Stringed musical instruments, e.g., guitars, mandolins, lutes, violins, cellos, and the like, both acoustic and electrically amplified, have traditionally been constructed of wood. More recently, stringed instruments have been made from wood, molded plastics, molded composite materials, or a combination of wood, plastics and composite materials. The body of the stringed musical instrument may be solid, semi-hollow, or hollow. The neck is typically solid and may further include a truss rod for increased neck strength.

Stringed musical instruments constructed of wood typically have a pleasing resonance but lack the durability of instruments that are made from synthetic composite materials. When composite materials are used or wood and composite materials are combined in the construction of a stringed musical instrument, the durability and strength of the instrument are improved. However, the bulk density of the composite materials is much greater than the density of wood, and the sound-absorbing properties of the composite materials are quite different than those of wood. Hence the resonances of the instrument are changed so that it may produce unpleasing and unacceptable tone characteristics, sometimes described as "inny."

Fiber-reinforced composites are appealing materials of construction for stringed instruments because such materials are light, stiff and far more resistant to environmental variables, particularly moisture and heat, than are the fine woods traditionally used. Composites are also mechanically stronger than other synthetic materials, e.g., molded plastics. For example, U.S. Pat. No. 4,290,336 describes a molded plastic guitar; this guitar has cost advantages but still requires ribs, a torsion rod, etc., to provide sufficient resistance to mechanical stresses. U.S. Pat. No. 4,313,362 discloses a molded plastic guitar; it features a reinforcement rod that runs from the butt end of the body to the upper portion of the peghead. U.S. Pat. No. 4,188,850 discloses a guitar made of metal and foamed plastic; the neck is formed of a metal body with plastic foamed around it. The neck of a stringed instrument is especially subject to warping because of the tension placed on it by the strings, which naturally varies across the strings from high to low. Thus, replacing all or part of the wood with a fiber-reinforced composite material has been a long-sought goal, especially for the neck of the instrument.

While the potential durability and strength of stringed instruments made in whole or in part of fiber-reinforced composite materials are well accepted, the tone qualities emitted by such instruments have not always been appreciated, nor have manufacturing methods that are simple and readily reproducible been available. Manufacturing methods for fiber-reinforced composite articles will preferably employ a minimum number of steps that require cutting, machining and joining. The resulting musical instruments will preferably emit pleasing tones.

The challenge of fabricating fiber-reinforced composite stringed musical instruments that produce pleasing sounds is appreciable. Composite materials, e.g., resins such as epoxy reinforced with fibers such as graphite, boron, or glass, differ greatly from wood in their acoustic damping properties. Wood is very "lossy"—heavily damping—in the sonic frequency range, especially in the high frequencies. While there has been extensive study of this topic, for example, Materials Research Society Symposium on Materials in Musical Instruments (1994), published in MRS Bulletin, XX, No. 3 (March 1995), the characteristics of pleasing sound quality are not readily quantified. The state of the art was summarized in quite an interesting way as follows ("Graphite Guitar Acoustics 101," John A. Decker, Jr., Nov. 4, 1999, http://www.rainsong.com/acc101.htm): "There have been a number of experiments where people were asked to tell a Stradivarius violin, say, from a junk student fiddle or a Ramirez classical guitar from a junk guitar when they were played behind a curtain. Even "naïve" subjects—people off-the-street—can almost always differentiate the quality instrument from the junk one. However, if one tries to identify them by their frequency spectrum or mode structure, even musical-instrument acoustic physicists who have spent their entire careers working in this field can't tell which is which."

The neck of a stringed musical instrument has been a focus of effort to strengthen and stiffen the instrument. U.S. Pat. No. 4,145,948 discloses a guitar neck constructed from graphite fiber reinforced plastic, in which the graphite fibers are oriented longitudinally to provide high stiffness in the direction of the strings. The neck components—the base of the neck, a top piece, and a fingerboard—are molded separately and then adhesively bonded together. No provision for sound frequency damping is disclosed. The inventor of the '948 patent, in a subsequent patent (U.S. Pat. No. 4,846,038), states that this hollow neck "requires an inordinate amount of machining and finishing." The '038 patent discloses a solid guitar neck that has a graphite fiber reinforced composite T-bar in the neck body, and an attached fingerboard into which are spiked the frets. U.S. Pat. No. 4,846,039 discloses a solid guitar neck formed from alternating layers of epoxy and powdered carbon, fiber reinforced. This solid neck may be constructed with an integral fingerboard. U.S. Pat. No. 4,950,437 also discloses a fiber-reinforced composite neck that can be constructed with an integral fingerboard, by wrapping resin-impregnated fiber cloth around a neck insert, placing the wrapped insert in a mold, pressing the fingerboard down on the top surface of the wrapped insert, and curing the resin. The neck insert can be removed to produce a hollow neck. No provision is disclosed for damping of high frequencies to improve the quality of the sound emitted. U.S. Pat. No. 6,100,458 discloses a composite neck for a stringed instrument; the neck is molded with resin-impregnated fiber cloth around a foam core.

The soundboard of the stringed musical instrument has also attracted innovative materials approaches. In acoustical instruments, most of the sound quality arises from the soundboard. U.S. Pat. Nos. 4,873,907 and 4,969,381 disclose a fiber-reinforced composite soundboard, with a foam core. In order to avoid the "tinny" sound of soundboards made entirely of graphite-resin composites, a layer of acoustically dead fabric such as Kevlar® or Dacron® can be incorporated into the layers of graphite fiber weaves before curing. The resulting bulk density of the composite is 2–4 times that of wood; the composite is made thinner so that the areal density is approximately the same as wood. The soundboard, side and back are made separately, machined and joined. U.S. Pat. No. 5,333,527 discloses an acoustic guitar soundboard composed of compression molded, graphite-reinforced epoxy plastic. The soundboard can be provided with bracing ribs similar to a wooden soundboard in the molding process or afterwards; the sound quality is stated to be capable of being manipulated by forming the soundboard with various curved surfaces. U.S. Pat. No. 6,107,552 discloses a thin and light but strong soundboard fabricated of two outer layers of graphite reinforced sheet material sandwiched around a layer of low-density core material, such as rigid polyvinyl chloride.

A challenge of using synthetic composite materials is adapting the range of sound frequencies produced to be satisfactory to the ear. In some cases the goal is to simulate as closely as possible the sound of a wood instrument; another goal may simply be the production of an inherently pleasant sound regardless of its similarity to the sound of a traditional wood instrument. For example, U.S. Pat. No. 5,905,219 discloses a polyurethane stringed instrument, where the density of the polymer is adjusted by adding various amounts of inorganic filler materials such as glass bubble, etc., with the goal of controlling the sound quality produced by the instrument. In composite materials, carbon fibers are desirable reinforcing fibers because of their high strength-to-weight ratio, their high modulus of elasticity, and their low coefficient of thermal expansion. A problem with achieving a pleasing sound with carbon-fiber-reinforced composites is their lower degree of energy absorption relative to wood, which is very lossy, especially at high frequencies. The lower degree of energy absorption is desirable for sustain qualities and harmonic clarity, yet is undesirable due to the relative excess in high frequencies. In general, some form of damping needed, such as the layer of acoustically dead fabric disclosed by U.S. Pat. Nos. 4,873,907 and 4,969,381 mentioned above. U.S. Pat. No. 4,364,990 discloses a fiber-reinforced composite material suitable for constructing stringed musical instruments, where this damping function is provided by a layer of "cellulosic material"—cardboard or paper—sandwiched between layers of graphite-epoxy prepreg which are then pressed and heated in a mold to permanently bond the mat of cellulose fibers within the cured composite. U.S. Pat. No. 5,895,872 seems to disclose a guitar basically formed from a graphite-epoxy composite, with some commingling of aramid fibers, presumably for sound-damping purposes. U.S. Pat. No. 6,087,568 describes an approach to control the tone qualities of a composite stringed instrument by formulating the composite material to include in addition to the resin carbon fibers, glass fibers, and a sound-damping filler such as glass microballoons.

One factor that motivates use of fiber-reinforced composite materials is the hope of simplifying the construction process. This goal has not been fully achieved. U.S. Pat. No. 5,955,688 discloses a stringed musical instrument exemplified as a violin made from graphite fiber reinforced epoxy resin. The fabrication is still relatively complex, with the body, belly and soundboard separately molded and then joined, whereupon a pair of struts, a soundpost, a bridge, and a string assembly are affixed.

There remains a need for a method for manufacturing fiber-reinforced composite stringed musical instruments, where the method is simple, reproducible, and may be readily scaled for manufacturing, and the resulting instruments emit pleasing musical tones and are light, strong and resistant to environmental degradation.

SUMMARY OF THE INVENTION

The present invention in one aspect relates to a stringed musical instrument or part thereof, where the instrument or part thereof is a unitary hollow structure. The stringed musical instrument or part thereof comprises an exterior shell structure formed in a resin matrix fiber-reinforced composite and an interior polymeric sound-damping layer bonded to all or a portion of the interior surface of the exterior shell. The resin matrix may be, for example, an epoxy, polyester, vinylester, or phenolic resin, or other suitable curable resin. The reinforcing fibers are strong and stiff fibers, for example, carbon, boron, silicon carbide, or tungsten; carbon is preferred. In addition to the reinforcing fibers, the composite may also include other light-weight fibers, such as glass fibers, present in separate layers or intermingled. The reinforcing fibers are present in the outermost and innermost layers. The interior sound-damping layer comprises an elastomeric material tightly bonded to all or part of the interior surface of the hollow composite. To enhance its appearance, the exterior surface of the instrument may have decorative features, for example, a molded-in exterior decorative textile layer, inlaid designs, or paint. The neck of the stringed musical instrument may be provided with frets that are adhesively attached to it rather than pounded in as traditional spike-like structures. Optionally, polymerized foam may be present in part or all of the hollow interior of the instrument or part thereof, to modify sound production.

In a preferred embodiment, the hollow stringed musical instrument or part thereof, comprises an exterior shell comprising an epoxy matrix, carbon fiber reinforced composite and an elastomeric sound-damping layer bonded to all or part of the interior surface of the exterior shell.

In another aspect, the invention comprises a process for the unitary molding of a fiber reinforced composite hollow stringed musical instrument or part thereof comprising the steps of:

- laying one or more pieces of fiber cloth into each of a top mold and a bottom mold, said top and bottom molds shaped to form respectively top and bottom portions of the hollow stringed musical instrument or part thereof, where the cloth pieces are sized so that cloth extends beyond the edges of the top and bottom molds, and where the cloth pieces are optionally impregnated with a heat-curable resin (prepreg);
- adding heat-curable resin as needed to the cloth in an amount sufficient to fully saturate the cloth;
- mating the top and bottom molds with an inflatable polymeric balloon inserted therebetween;
- inflating the polymeric balloon to a pressure sufficient to press the cloth pieces firmly against the molds; and
- heating the mated molds to a curing temperature for a curing time sufficient to cure the heat-curable resin.

In preferred embodiments, the resin matrix is selected from epoxy, polyester, vinylester, or phenolic resins and the reinforcing fibers are selected from carbon, boron, silicon carbide, and tungsten fibers. The process may further comprise placing one or more additional layers of fiber cloth into each of the top and bottom molds, where the additional layers of fiber cloth may contain the reinforcing fibers, glass fibers, or a mixture of both fiber types. In preferred embodiments, carbon-fiber-containing cloth and glass-fiber-containing cloth are laid in the molds in 2 to 20 layers, with the carbon-fiber-containing cloth being used for the first and last cloth layers. In especially preferred embodiments, the carbon-fiber-containing cloth and glass-fiber-containing cloth are laid in the molds in such a manner as to create alternating carbon-fiber-reinforced and glass-fiber-reinforced layers in the hollow cured composite structure, with carbon-fiber-reinforced layers forming the exterior surface and the interior surface which is bonded fully or partially to an elastomeric sound-damping layer.

In a further aspect of the invention, the process for the unitary molding of a hollow stringed musical instrument or part thereof comprising the steps of:

laying one or more pieces of fiber cloth into each of a top mold and a bottom mold, said top and bottom molds shaped to form respectively the top and bottom halves of the hollow stringed musical instrument or part thereof, where the cloth pieces are sized so that cloth extends beyond the edges of the top and bottom molds, and where the cloth pieces are optionally impregnated with a heat-curable resin;

adding heat-curable resin as needed to the cloth in an amount sufficient to fully saturate the cloth;

mating the top and bottom molds;

curing the heat-curable resin by a vacuum molding process; and coating an interior surface of the hollow stringed musical instrument or part thereof with a polymeric sound-absorbing coating. This material is typically an elastomer such as rubber, silicone, etc.

In preferred embodiments, the resin matrix is selected from epoxy, polyester, vinylester, or phenolic resins and the reinforcing fibers are selected from carbon, boron, silicon carbide, and tungsten fibers. The process may further comprise placing one or more additional layers of fiber cloth into each of the top and bottom molds, where the additional layers of fiber cloth may contain the reinforcing fibers, glass fibers, or a mixture of both fiber types. In preferred embodiments, carbon-fiber-containing cloth and glass-fiber-containing cloth are laid in the molds in 2 to 20 layers, with the carbon-fiber-containing cloth being used for the first and last cloth layers. In especially preferred embodiments, the carbon-fiber-containing cloth and glassfiber-containing cloth are laid in the molds in such a manner as to create alternating carbon-fiber-reinforced and glass-fiber-reinforced layers in the hollow cured composite structure, with carbon-fiber-reinforced layers forming the interior and exterior surfaces.

The process of fabricating the instrument may also include providing the exterior surface of the instrument with decorative features, for example, a molded-in exterior decorative textile layer, inlaid designs, or paint. The neck of the stringed musical instrument may be provided with frets that are adhesively attached to it rather than pounded in as traditional spike-like structures. The instrument may be provided with magnetic or piezoelectric pick-ups for sound amplification.

DETAILED DESCRIPTION OF THE INVENTION, AND PREFERRED EMBODIMENTS THEREOF

Figure 1:
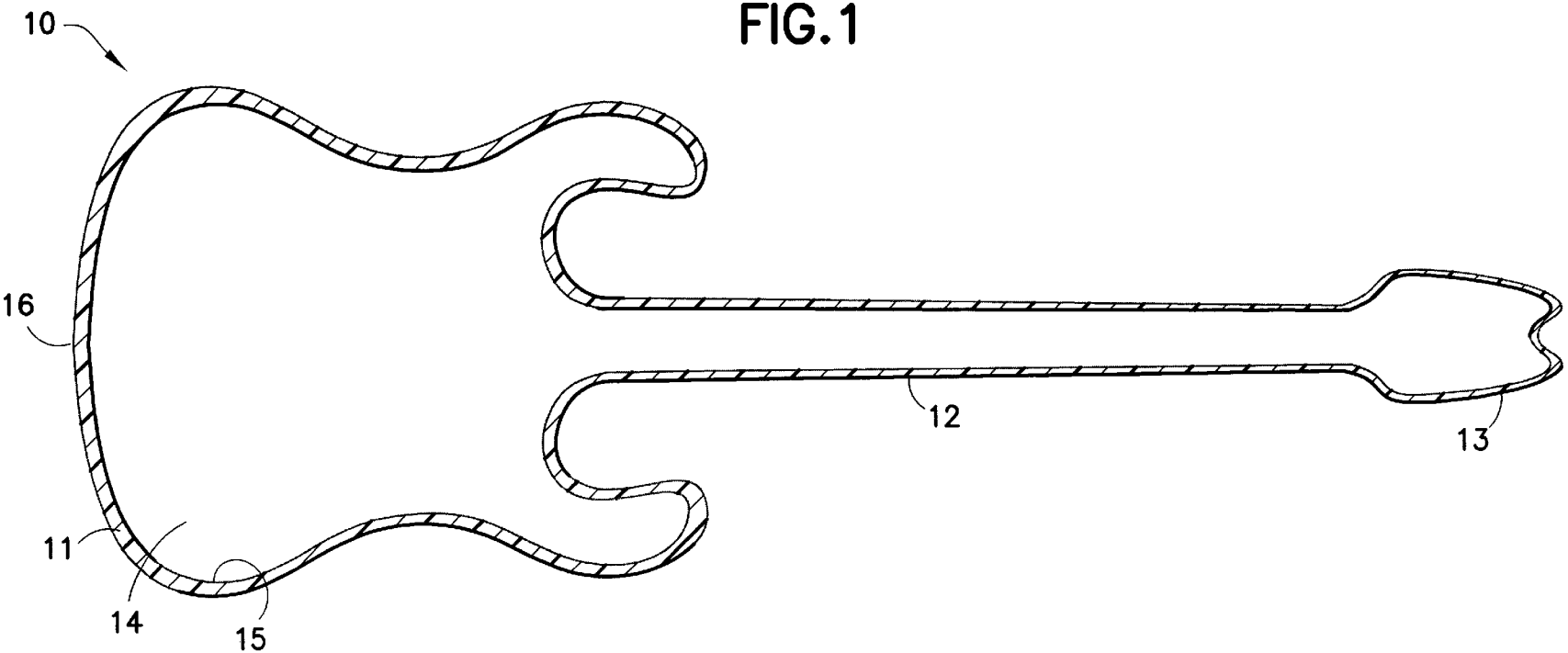
FIG. 1 depicts schematically a top view of a composite guitar according to the present invention.
Figure 2:
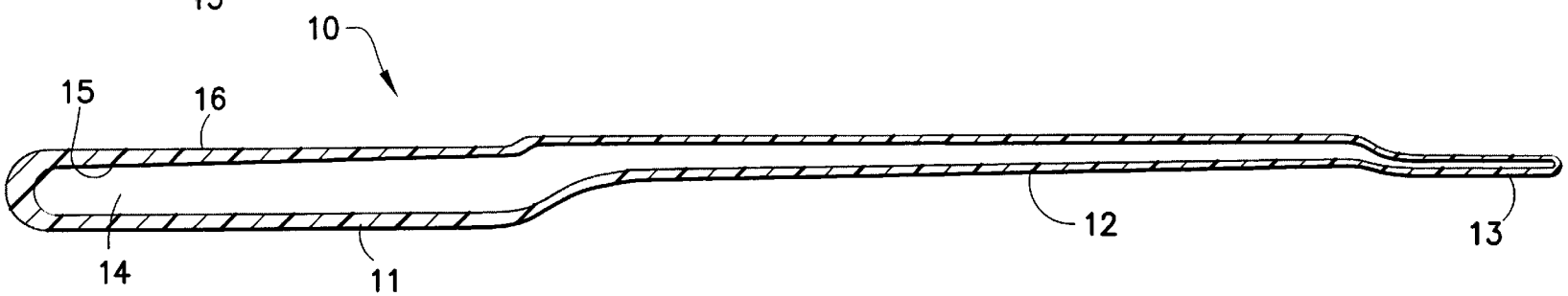
FIG. 2 depicts schematically a side view of a composite guitar according to the present invention.

By the method of the invention, a hollow or partially hollow stringed musical instrument may be constructed partially or wholly of composite materials of a thickness such that the resulting instrument has an areal density similar to that of wood. Further, the method provides a sound-damping layer bonded to some or all of the interior surfaces of the composite material portions of the instrument. By "sound-damping layer" it is meant a layer that absorbs sound frequencies, and the higher sound frequencies are absorbed more than lower frequencies. The appropriate frequencies are thereby damped to produce pleasing sound quality, similar to wood stringed musical instruments, while retaining the advantageous durability and strength of composite materials.

The sound-damping layer provided by the present invention had numerous advantages over earlier approaches. It is simple to implement, reproducible, and is readily scaled for manufacturing. Hollow composite stringed instruments provided with this sound-damping layer emit pleasing musical tones and are strong and resistant to environmental degradation.

In stringed instruments, the entire body, including the top and back plates or case, the ribs, the enclosed air, and all of the attachments, form a highly complex vibrating system. Constructing instruments from composites can simplify construction to the point where it is feasible to manipulate sound quality through variations in the shape of the instrument and its hollow cavities. Further the hollow cavities can be filled with various sound-damping materials to manipulate the range of sound frequencies emitted.

By the method of the invention, a composite stringed musical instrument may be molded to form an instrument that has one hollow chamber comprising a unitary body and neck sharing the same cavity. Alternatively, the neck may comprise a separate hollow or solid structure, which may be attached to a solid or hollow body structure. The neck or the body or both are formed of composite materials, with a sound-damping layer bonded to some or all of the interior surfaces of the composite material portions of the instrument. The frequencies emitted by the instrument may be altered by filling in all, some, or none of the hollow cavities with foam or other solid, sonic-frequency-absorbing material. Acoustic instruments may be made with little or no foam damping material added. Partial foaming or complete foaming of the cavity can be used to produce desired resonance characteristics, especially for electrically amplified instruments.

Because the composite materials used for construction of the stringed musical instrument are strong and stiff, the neck of the instrument does not require a truss rod or other reinforcement. The instrument can optionally be molded so that the portion of the neck of the instrument to which tuning pegs are to be attached will be solid, by appropriate design of the mold for the instrument and arrangement of fiber cloths or mats in the mold.

In the figures described below, similar numerals refer to similar structures within each figure. The figures are generally illustrative and are not shown in exact scale or proportion.

FIGS. 1 (top view) and 2 (side view) show schematically a hollow guitar 10 made of composite material by the method of the invention. The guitar comprises a unitary exterior shell comprising body 11, neck 12 and headstock 13, with a common hollow cavity 14. The exterior shell is formed of resin matrix fiber reinforced composite. An interior layer comprising a polymeric sound-damping substance is bonded to all or a portion of the interior surface 15 of the exterior shell. The exterior surface 16 of the guitar may optionally feature decorative elements (not shown). A hollow part for a stringed musical instrument, such as a neck or body, may be constructed in the same manner.

Figure 3A:
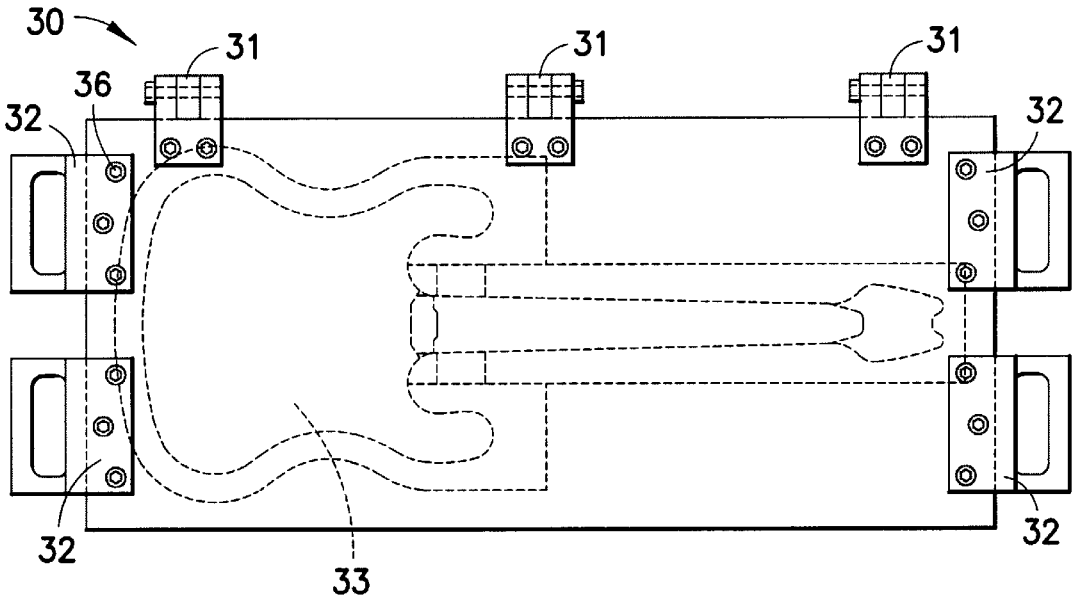
FIGS. 3A–3H show schematically a mold set that is suitable for molding a composite guitar of the invention: 3A, in the closed position (top view); 3B, in the closed position (side view); 3C, the top mold piece laid open; 3D, the bottom mold piece laid open; 3E, top/back (closed); 3F, top/front (closed); 3G, bottom (closed); and 3H, end perspective (closed).
Figure 3B:
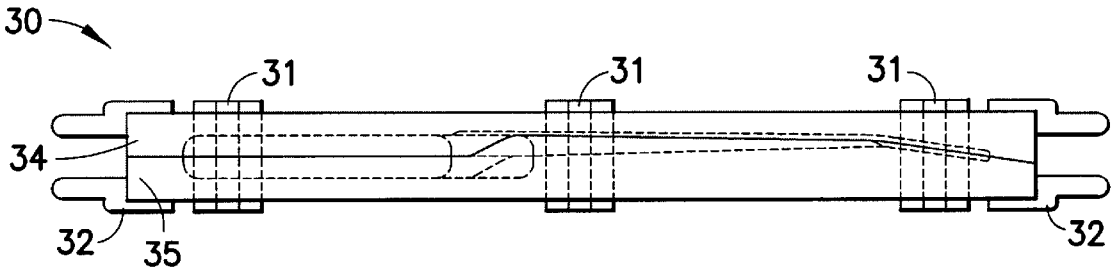
Figure 3C:
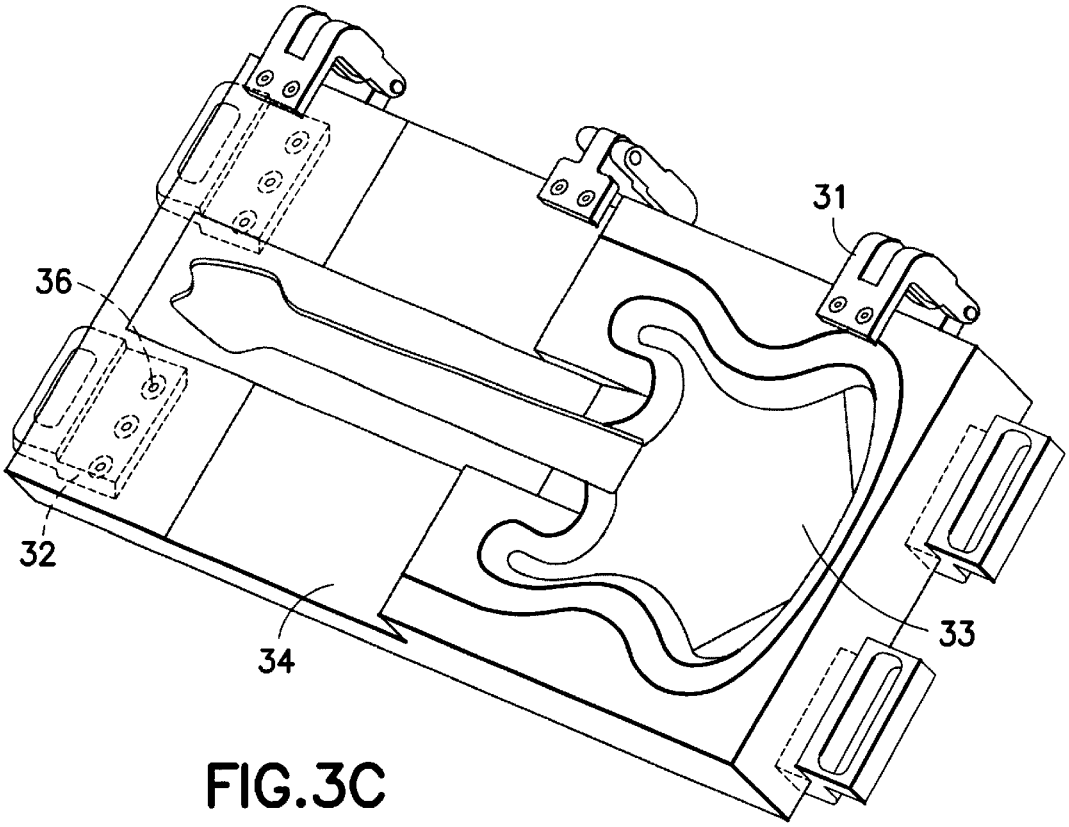
Figure 3D:
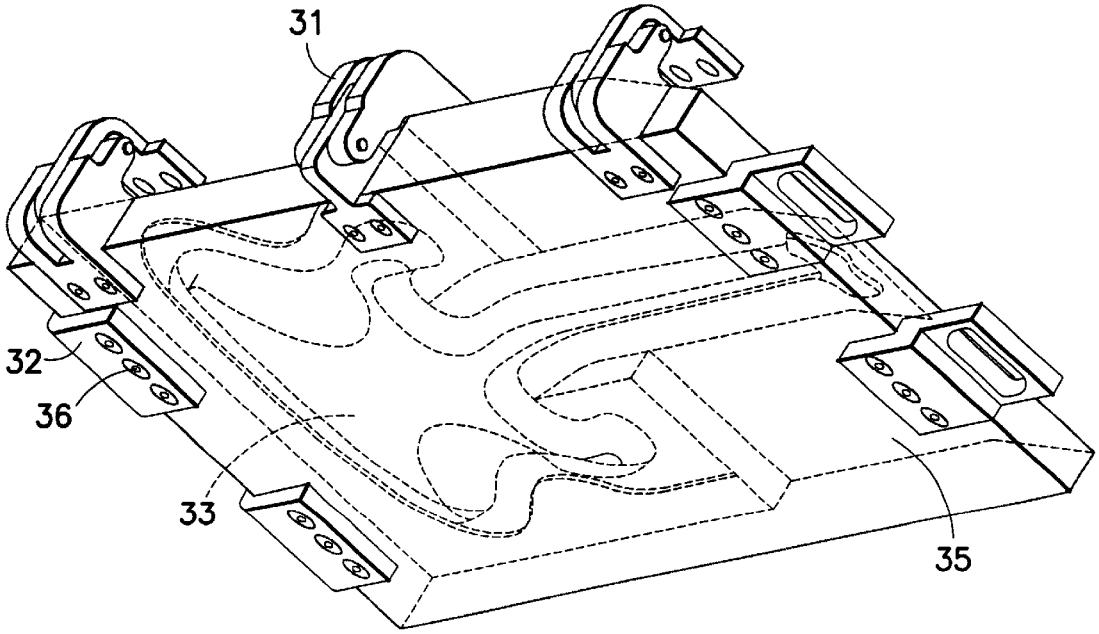
Figure 3E:
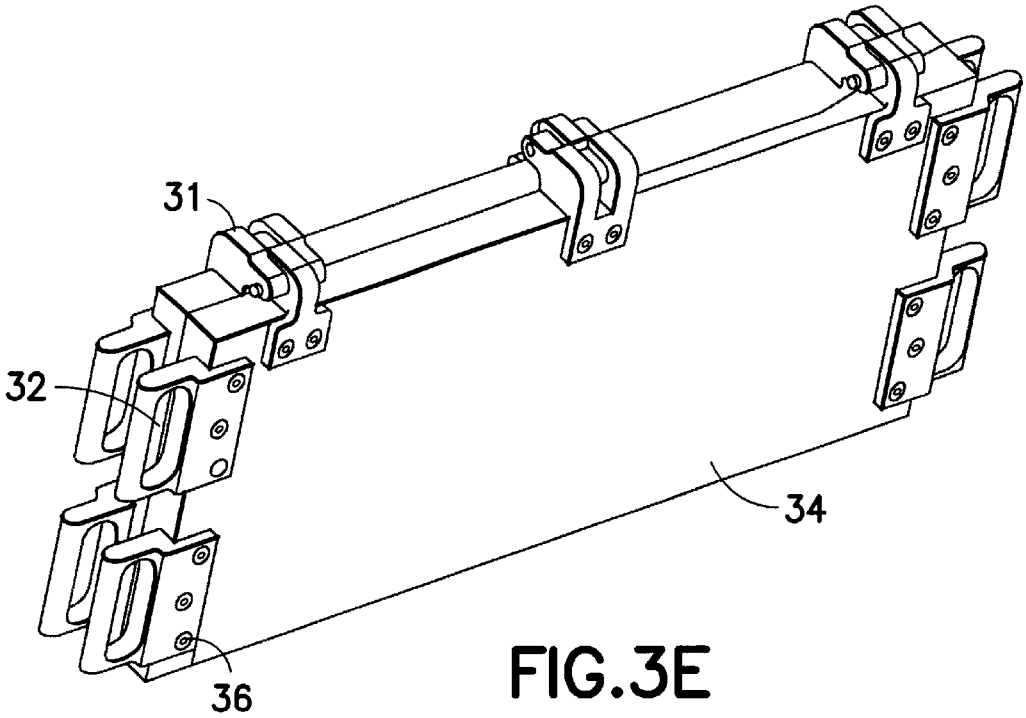
Figure 3F:
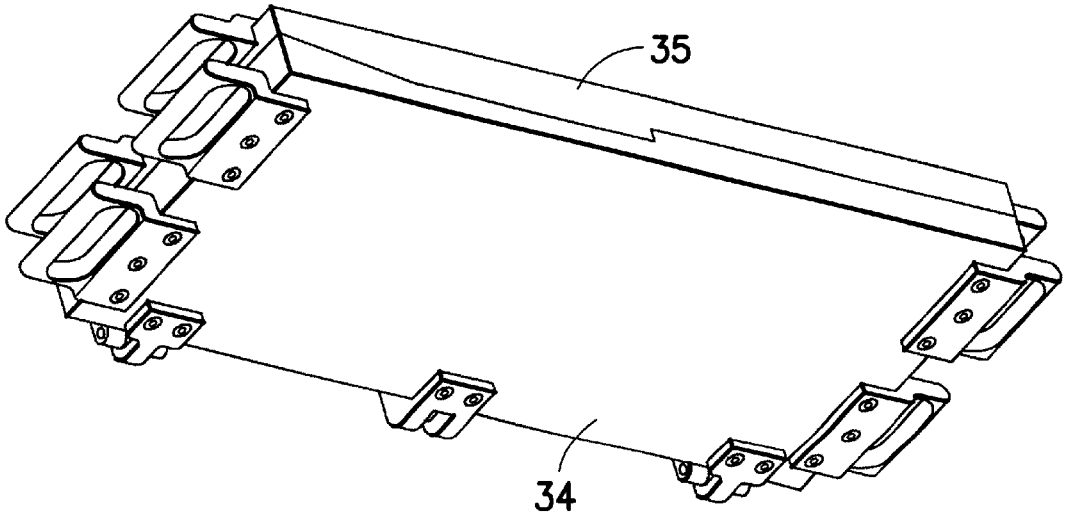
Figure 3G:
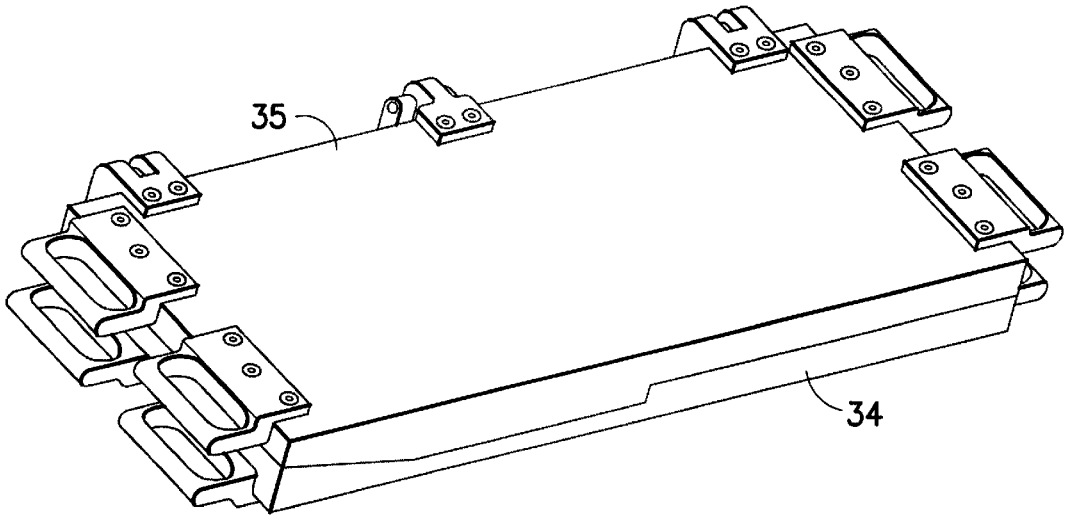
Figure 3H:
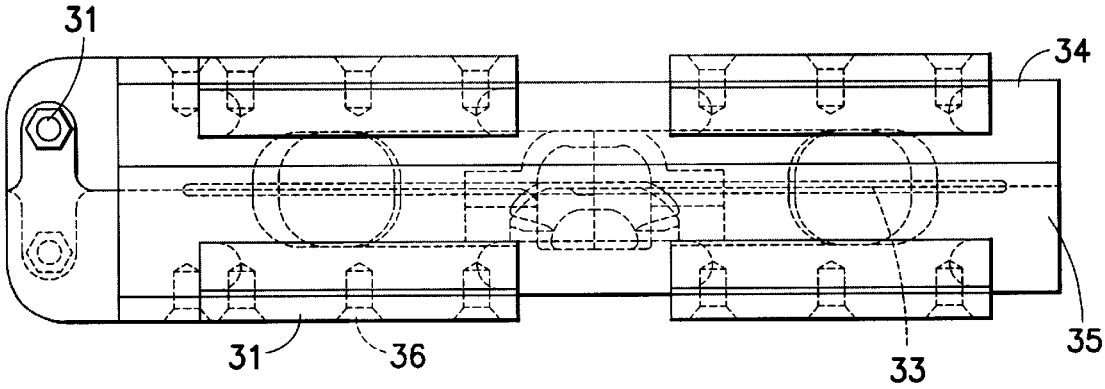

An exemplary mold for forming a hollow stringed musical instrument is shown schematically in FIGS. 3A–3H. FIG. 3A depicts a top view and 3B a side view of a mold set 30 that is suitable for molding a composite guitar, in the closed position. The mold top piece 34 opens out from bottom piece 35 on hinges 31. When the mold is closed, clamps 32 are tightened with screws 36 during the curing process. The receptacle area 33 will hold the guitar as it is molded. FIGS. 3C and 3D show respectively the top mold piece 34 and bottom mold piece 35 laid open. FIGS. 3E, 3F, 3G and 3H show the mold set closed and clamped together so that heat can be applied to cure the fiber-reinforced resin material, viewed respectively from the top/back, top/front, bottom and end perspectives. The fiber-reinforced composite includes refractory reinforcing fibers that are strong and stiff, such as carbon, boron, silicon carbide, tungsten and the like. Carbon (graphite) fibers are especially preferred. Desirable reinforcing fiber properties include high strength, light weight, excellent fatigue resistance, good creep and damping properties, excellent corrosion resistance, low friction and wear, and low thermal expansion. Carbon fibers possess all of these properties. The composite may also include other supplemental fibers such as glass or aramid, which may be used to make the composite material less dense, modulate the sound qualities of the instrument, lower its materials costs, and/or provide an appropriate weight and balance. Glass fibers are useful for these purposes. Graphite and glass fibers may be provided in the form of a weave or a mat; weaves are preferred for the graphite fibers. The graphite and glass fibers may be provided together or in separate fabrics that can be layered into the mold.

The polymeric resin can be any suitable material which may be cured to form a lightweight, strong polymer, for example, epoxy, polyester, vinylester, or phenolic resins. Epoxy is currently preferred. The resin may be added to the fiber lay-up separately, or may be already impregnated into the fibers to form a prepreg.

The sound-damping layer bonded to some or all of the interior surfaces of the hollow musical instrument is formed of an elastomeric material such as rubber or silicone. The sound-damping damping material must be capable of forming a layer whose thickness can be controlled and which can be bonded tightly to the selected interior surface(s). The bond must be resilient to all the conditions of storage and use of the musical instrument. Suitable elastomeric materials include natural rubber, silicone polymers, butadiene-styrene rubbers, polyurethanes, polyethylene terephthalate, block copolyether ester elastomers, and the like. The elastomeric material may be bonded to the selected interior surface(s) by heat during the molding process. Exemplary elastomeric materials useful in this process include rubber materials such as natural rubbers, silicone rubbers, and butadiene-styrene rubbers. Alternatively the elastomeric material may be applied as a liquid coating which cures to form a bond to the selected interior surface(s). Exemplary liquid materials useful in this process include liquid silicones such as silicone adhesives, e.g. Dow-Corning® Adhesive 732 plus base 3110. Other useful liquid materials for this step include noise absorbent coatings suitable for application to solid surfaces. Many such materials are known. For example, coating materials have been formulated for the surfaces of submarines to reduce noise emissions.

The stringed musical instrument or part thereof can be fabricated as described below, or through straightforward modifications or elaborations of these steps, which are well-known to practitioners of the fiber-reinforced composites art.

A mold is provided that has a top mold piece and a bottom mold piece with receptacle areas that are shaped to form respectively the top and bottom portions of a hollow stringed musical instrument or part thereof. The mold can be made of any material that will survive the curing conditions; preferable molds are made of aluminum, composites, stainless steel or the like. The musical instrument may be molded as one unitary body with a common hollow cavity throughout, or a part of the instrument, such as the neck, may be molded separately and later attached to the other portion, e.g., body, of the instrument. Because the composite materials are stiff and light, parts that would normally be made separately and later attached to the main body can be made as unitary parts of the molded instrument. For example, the mold may include a form shaped to produce an integral fingerboard and an integral peghead. These parts may alternatively be made separately and later attached. Before use, the mold is typically coated with a mold-release agent; such materials are well-known to fabricators.

At least one piece of reinforcing fiber cloth is laid into the top mold, and at least one piece of fiber cloth is laid into the bottom mold. The cloth pieces are sized so that cloth extends beyond the edges of the top and bottom molds, sufficient to bond to form a good joint when the mold pieces are clamped together for the curing step. The fiber cloth includes reinforcing fibers that are strong and stiff and suitable for reinforcing a polymer, such as carbon, boron, silicon carbide, or tungsten fibers and the like. The fiber cloth may present the reinforcing fibers as a weave, e.g., a plain weave, a twill, etc. or as a fiber mat. Weaves are preferred.

The reinforcing fibers may optionally be supplemented with other fibers whose role is to make the composite material less dense, modulate the sound qualities of the instrument, lower its materials costs, and/or provide an appropriate thickness, weight and balance. These supplemental fibers are desirably light-weight and unreactive in the composite. Glass is an exemplary supplemental fiber, especially in the form of a fiberglass cloth, either a weave or a mat. Fiberglass mat is preferred.

The reinforcing fibers and the supplemental fibers can be provided together or separately. For example, fabrics that consist of carbon fibers and S-glass fibers together are available from Carbon Composites Co. (Paia, Hi.). As a practical matter, it is often desirable to use several layers of fiber cloth. For example, a cloth comprising a carbon fiber weave may be used in combination with a fiberglass cloth. Layers of the reinforcing fiber cloth can be alternated with layers of the supplemental fiber cloth. When two types of cloth are used, leading to distinct layers in the cured composite, the first layer of cloth laid into the mold must be a layer of the reinforcing fiber cloth, so that the material can ultimately form the exterior of the musical instrument (e.g., carbon reinforced composite). Likewise, the last layer will also be a layer of the reinforcing fiber cloth, so that the interior surface of the instrument is also formed from that material (e.g., carbon reinforced composite). An example of a useful layering pattern is: G, G, F, F, G, G, F, F, G, G. G represents a layer of graphite woven fabric and F represents a layer of fiberglass mat. This layering pattern produces a cured composite that has three layers of graphite-reinforced composite alternating with two layers of fiberglass composite, and the graphite reinforced layers form the innermost and outermost layers.

Multilayered structures have strength-to-weight and cost advantages. In some preferred embodiments, the cured composite has n carbon fiber layers alternating with m glass fiber layers, where n ranges from 2 to 7 and m=n−1.

In preferred embodiments, the number of layers of fiber cloth is selected to produce a thickness of the cured composite material in the range of about 0.05 to 0.2 inch. Thicknesses in the range of 0.08 to 0.125 inch are preferred. The number of layers of fiber cloth used will depend on the properties of the cloth and typically ranges from 3 to 25 cloth layers. When two or more pieces of the same type fiber cloth are laid adjacent, they form essentially one layer of that type of material in the final cured composite.

The reinforcing and supplemental fiber cloth pieces may be already impregnated with resin ("prepreg"); if not or if more resin is needed, sufficient resin to saturate or fully impregnate the cloth layer(s) is added to the cloth layer(s) after they are laid into the mold pieces. As is well known to practitioners, sufficient resin must be added so that the cured composite does not have voids of a number that degrade its mechanical properties. The mold pieces are then mated, clamped tightly, and the resin is cured under appropriate conditions to fully harden the polymeric material.

In one variation of the method, before the mold pieces are mated, an inflatable polymeric bladder or balloon is inserted therebetween. After the mold pieces are mated and clamped, the bladder or balloon is pressurized to a pressure sufficient to firmly hold the fiber cloth layers against the mold's interior surface. The resin composite is then cured by heating. At the elevated temperatures of curing, the polymeric balloon material is melded into the surface of the fiber cloth, and forms a tight bond to it. The hollow musical instrument so produced therefore has a polymeric coating on some or all of its interior surface, depending on how the balloon was used. This coating is highly desirable because of its sound-absorbent properties. It is especially useful for damping out the frequencies that give the composite musical instrument an unnatural and unpleasant sound. The bladder method not only provides needed sound-damping in the final product, but by pressing the cloth layers tightly against the mold's interior surface, it is also is a simple way to avoid the formation of pores and void volumes in the composite during curing.

In another variation of the method of the invention, the fiber-resin composite is cured by vacuum molding. A curable polymeric coating is then applied as a fluid to some or all of the interior of the musical instrument and allowed to dry or cure to form a coating of desired thickness and sound-absorbing properties. The vacuum molding/polymer coating method also results in an interior coating that provides the needed sound damping; the coating may be applied to selected portions of the interior surface of the hollow musical instrument.

In yet another variation of the method of the invention, only a first layer of reinforcing fiber cloth is laid into the mold pieces, and resin is added if needed (if the cloth was not prepreg or if it needed additional resin). This first layer is cured by vacuum molding and inspected for smoothness and the absence of voids. Well-formed outer shells are returned to the mold for additional layers of fiber cloth (reinforcing and/or supplemental) to which more resin is added as needed before a second curing step. The second curing step may be accomplished by either the bladder method or the vacuum molding/polymer coating method. The advantage of proceeding in a two-step curing process is that it avoids wasting material when the outer layer is not sufficiently smooth and void-free to be acceptable to the instrument's user.

In another variation of the method of the invention, after the mold pieces are mated, a fast-curing foam is blown into the space between the top layers and bottom layers of resin-impregnated fiber cloth, to press them firmly against the mold surfaces. The foam-filled mold is then held at a curing temperature for a time sufficient to cure the fiber-reinforced composite material. After the curing is complete, some or all of the foam can be removed, as desired for optimal sound production. If the instrument is to be electrically amplified, it may be desirable to leave much of the polymerized foam intact.

In an extension of the methods of the invention, the stringed musical instrument can be provided with a decorative layer. A layer of decorative textile, for example silk, colored polymer fibers such as Kevlar® aramid fibers, may be placed into the mold before any of the fiber cloth layers are added. Sufficient resin to thoroughly saturate the decorative cloth is added. The reinforcing fiber cloth layer(s) and any desired supplemental fiber cloth layer(s) are added; the mold is clamped and cured. The resulting instrument has an attractive exterior. Additionally, designs formed of inlay materials such as colored plastic, shells, etc., can be included in the exterior surface before the resin is cured. The cured composite instrument can be painted or otherwise decorated, although the cured fiber-reinforced composite material itself is attractive.

The musical instrument produced by any of the variations above will have at least one hollow cavity. Solid materials or foamed materials can be inserted into the cavity(s) as desired, to modulate the sound quality by absorbing some sound frequencies preferentially.

After molding and curing are complete, the instrument is removed from the mold, and the rim around the edge where the mold pieces were clamped together and the fiber cloths extended beyond the mold edges is trimmed off and the surface of the instrument is sanded to the desired smoothness. Any optional decorative coatings or finishes are added. The instrument is provided with a bridge, nut, tuners, frets, and strings, and optionally pick-up(s) and a pre-amplifier.

Figure 4:
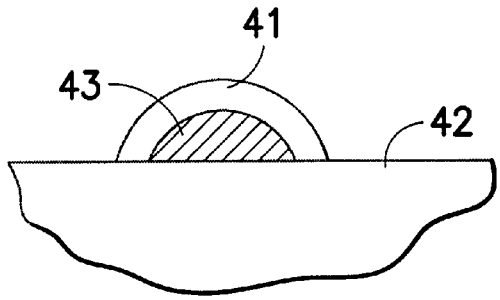
FIG. 4 shows a schematic side view of a fret that can be attached by adhesives, to the neck of the stringed musical instrument.
Figure 5:
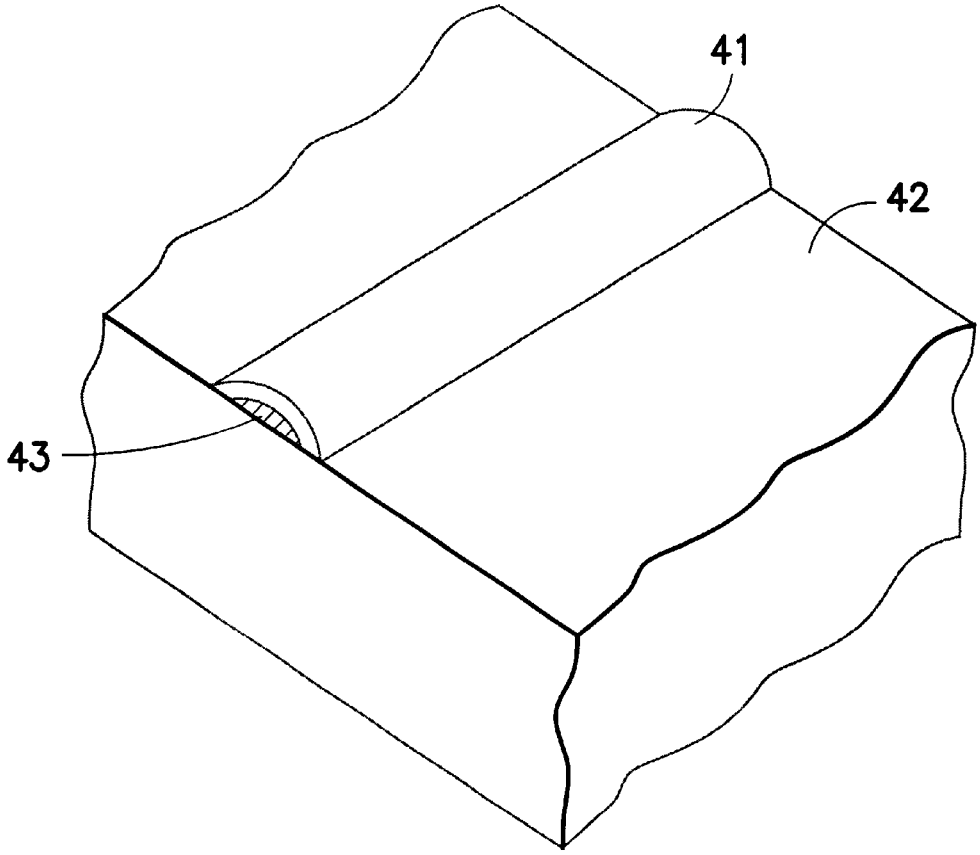
FIG. 5 shows a schematic top view of a fret that can be attached by adhesives, to the neck of the stringed musical instrument.

The neck of the instrument may or may not have frets depending on its application. Frets are thin pieces of metal, usually stainless steel, placed at specific intervals along the neck for string termination. The fiber-reinforced composite material is stiff and light so that hollow parts, e.g. the neck, are sufficiently strong that they do not need reinforcing bars and the like. It is desirable to avoid piercing the hollow neck along its length, so that its strength will not be compromised and sound quality will not be degraded. Hence, rather than the standard frets applied to traditional wooden instruments, the invention provides an arched fret that can be adhesively attached to the fingerboard area. Traditional frets have a spike-like base that is pounded into the fingerboard to attach the fret. This method of attaching the fret is sturdy, but for the invention's hollow composite necks made with integral fingerboard areas, it has the disadvantage that may compromise the strength of the neck of the guitar. FIGS. 4 and 5 show such a fret useful for attaching to hollow instruments of the invention. The fret 41 has an arched profile. It is glued to the surface 42 of the fingerboard area by a bead of adhesive applied in the space 43 between the arched area and the surface. Suitable adhesives include cyanoacrylate resins ("Superglue") and the like.

The instrument will have a bridge, located at the center of the body. The bridge's purpose is to terminate one end of the string and to transfer vibrations from the strings into the body of the instrument. There are many styles of bridges, but basically there are only two types, fixed and variable. Fixed bridges are those that do not change the tension of the strings. Variable bridges are those that can vary the tension of the strings while playing the instrument. One example of the variable bridge is the "Floyd Rose" adjustable bridge.

The nut is located at or near the end of the neck. The nut's purpose is to terminate the other end of the string for vibration termination. The string is then connected to the tuner located at the end of the neck, one for each string. They are used to tighten the strings to the desired tuning of the instrument.

The instrument may have a pick-up used for amplification. The two types of pick-ups are the electric or magnetic pick-up and the piezoelectric pick-up. The magnetic pick-up senses the changes in the electromagnetic field from the movement of the strings, which is then converted into an electrical signal to be amplified. A magnetic pick-up will only work with ferrous strings such as nickel or steel. The piezoelectric pick-up is placed under the bridge located in the center of the body of the instrument. The piezoelectric pick-up senses vibrations from the strings to activate its crystals, which converts the vibration energy into an electrical signal to be amplified. Any type of string can be used with the piezoelectric pickup. If a pick-up is used, it is usually connected to a volume and or tone control before connected to a ¼ inch audio jack. Some pick-up systems may also include a pre-amp to ensure a strong signal for the amplifier. For example, excellent pickups are available from Fishman Transducers, Inc. (Wilmington, Mass.).

EXAMPLE

Figure 6:
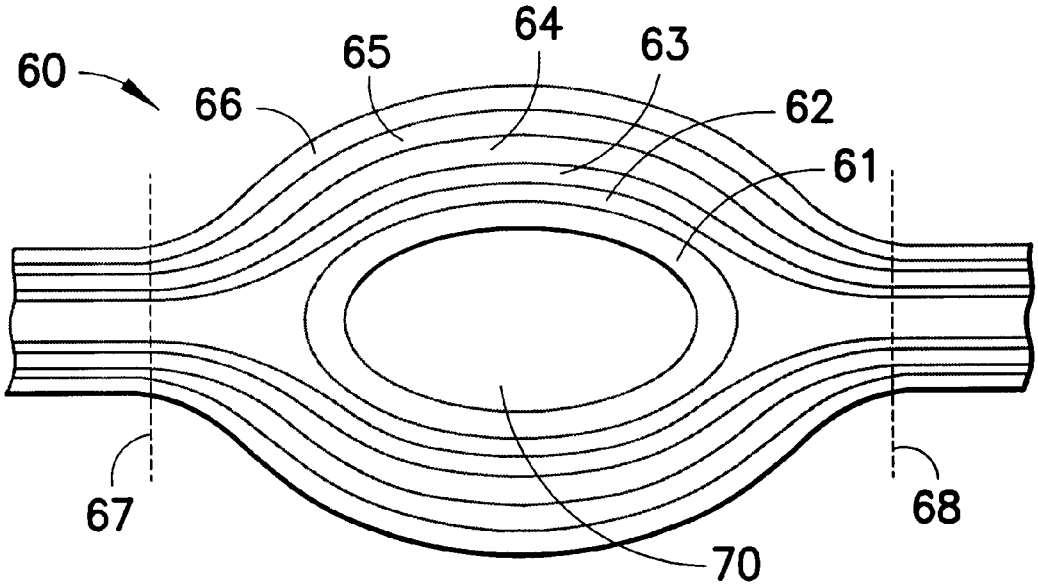
FIG. 6 shows a schematic diagram of a cross-section across the long axis of a hollow stringed musical instrument made by the method of the invention.

A two piece mold set was prepared with a top and a bottom piece, each with a recessed area shaped to be able to mate to form the neck of an electric guitar, said neck shaped so as to have an integral fingerboard. The mold interiors were coated with mold release agent. Graphite fabric (100% Carbon Fabric 3K×3K, Part No. 3582-50V, Carbon Composites Co., Paia, Hi.) and fiberglass fabric (1½ ounce fiberglass mat, Diversified Materials Co., La Mesa, Calif.) were cut into suitable shape to fit into the mold top and bottom pieces, with an allowance so that the fabrics could extend about 3.5 cm beyond the edges of the recessed areas. Alternating layers of the graphite fabric and fiberglass fabric were laid into the top and bottom molds in the following order, where G represents a layer of graphite fabric and F represents a layer of fiberglass fabric: G, G, F, F, G, G, F, F, G, G. Epoxy resin (a combination of product #1320 resin with product #3138 hardener; Jeffco Products, San Diego, Calif.) was added to the layers of cloth in the mold pieces. A rubber bladder (standard bicycle tire inner tube) was laid on top of the fabric layers in the bottom mold, and the mold pieces were mated and clamped. The bladder was inflated using compressed air (40 psi). The mold pieces were shallower at either end, so that when the mold pieces were clamped in place with the resin-impregnated fiber cloths situated within, regions near either end were solid. There regions corresponded approximately to the tuning peg head region and the region through which the bolts for attaching the neck to the guitar body would pass. The clamped mold was placed in an oven and heated at 60°–80° C. for 1.5 hours. The mold was removed from the oven and allowed to cool to room temperature. The mold pieces were separated, the resulting hollow neck structure, with a rubber coating bonded to its interior, was removed from the mold. FIG. 6 shows schematically the layered structure that resulted. FIG. 6 depicts a cross-section view 60 approximately midway along its length across the long axis of the guitar neck. The inner composite layer 62 arose from the first layers (G, G) of graphite fabric and comprises graphite-fiber-reinforced epoxy; mid layer 63 and mid layer 65 are fiberglass reinforced epoxy each arising from two fiberglass mat layers; mid layer 64 and outer layer 66 are graphite-fiber-reinforced epoxy. During the curing step, the rubber bladder bonded to inner layer 62 to form sound-damping layer 61. The hard rim produced by the excess fabric extending beyond the mold was trimmed at approximately the cuts defined by dotted lines 67 and 68 and then sanded to produce a smooth guitar neck. Stainless steel frets were glued to the fingerboard area of the neck as described above. The neck was provided with tuning pegs and strings and attached by four bolts to a solid wooden electrical guitar body (Fender "Stratocaster" style) which was provided with magnetic pick-ups (EMG Corp., Santa Rosa, Calif.) electrically connected to a sound amplification system. The resulting guitar had exceptionally pleasing sound quality and did not warp or otherwise degrade over extensive playing time. The guitar equipped with this neck produced tones with excellent sustain and volume.

While the invention has been described herein with reference to various illustrative features, aspects and embodiments, it will be appreciated that the invention is susceptible of variations, modifications and other embodiments, other than those specifically shown and described. The invention is therefore to be broadly interpreted and construed as including all such alternative variations, modifications and other embodiments within its spirit and scope as hereinafter claimed.

What is claimed is:

1. A hollow stringed musical instrument or part thereof having an interior space, comprising:

an exterior shell having an exterior and interior surface; and an interior layer bonded to at least a portion of the interior surface of the exterior shell, wherein the exterior shell comprises a resin matrix fiber reinforced composite and the interior layer comprises a continuous non-foam elastomeric sottnd-damping layer bonded to all or a portion of the interior surface to the exterior shell to form a continuous sound-damping layer and separate the resin matrix fiber reinforced composite from the interior space.

2. A hollow stringed musical instrument or part thereof as in claim 1, wherein the resin matrix is selected from the group consisting of epoxy, polyester, vinylester, and phenolic resins.

3. A hollow stringed musical instrument or part thereof as in claim 1, wherein the reinforcing fibers are selected from the group consisting of carbon, boron, silicon carbide, and tungsten.

4. A hollow stringed musical instrument or part thereof as in claim 3, wherein the reinforcing fibers are carbon.

5. A hollow stringed musical instrument or part thereof as in claim 3, further comprising glass fibers.

6. A hollow stringed musical instrument or part thereof as in claim 5, wherein the reinforcing fibers and glass fibers are present in 3 to 15 layers, and the reinforcing fibers are present in the outermost and innermost layers.

7. A hollow stringed musical instrument or part thereof as in claim 6, wherein:

the reinforcing fibers are carbon fibers;

the carbon fibers are present in n carbon fiber layers, where n ranges from 2 to 7;

the glass fibers are present in m glass fiber layers, where m=n−1; and the carbon fiber layers alternate with the glass fiber layers.

8. A hollow stringed musical instrument or part thereof as in claim 7, wherein n is 3, m is 2, and the interior sound-damping layer is selected from the group consisting of natural rubbers, silicone rubbers, and butadiene-styrene rubbers.

9. A hollow stringed musical instrument or part thereof as in claim 1, wherein polymerized foam is present in part or all of the hollow interior of the instrument or part thereof.

10. A hollow stringed musical instrument or part thereof as in claim 1, wherein the stringed musical instrument is provided with arched frets, each arched fret defining a space between the arched area and a surface of the instrument and attached to said surface by a bead of adhesive applied in said space.

11. A process for the unitary molding of a fiber reinforced composite hollow stringed musical instrument or part thereof comprising:

laying one or more pieces of fiber cloth into each of a top mold and a bottom mold, where the top mold and bottom mold are shaped to form respectively top and bottom portions of the hollow stringed musical instrument or part thereof, where the cloth pieces are sized so that cloth extends beyond the edges of the top and bottom molds, and where the cloth pieces are optionally impregnated with a heat-curable resin;

adding heat-curable resin as needed to the cloth in an amount sufficient to saturate the cloth;

mating the top and bottom molds with an inflatable polymeric balloon inserted therebetween;

inflating the polymeric balloon to a pressure sufficient to press the cloth pieces firmly against the molds; and heating the mated molds to a curing temperature for a curing time sufficient to cure the heat-curable resin.

12. A process according to claim 11, wherein the resin matrix is selected from the group consisting of epoxy, polyester, vinylester, and phenolic resins, and the reinforcing fibers are selected from the group consisting of carbon, boron, silicon carbide, and tungsten fibers.

13. A process according to claim 11, further comprising laying one or more pieces of fiber cloth into each of a top mold and a bottom mold, where one or more pieces of fiber cloth contain glass fibers.

14. A process according to claim 11, wherein the carbon-fiber-containing cloth and glass-fiber-containing cloth are laid in the molds in 3 to 15 layers.

15. A process according to claim 14, wherein the carbon-fiber-containing cloth and glass-fiber-containing cloth are laid in the molds in alternating layers.

16. A process according to claim 11, wherein the hollow stringed musical instrument or part thereof is a neck part.

17. A process according to claim 11, wherein the neck is provided with frets attached by an adhesive.

18. A process for the unitary molding of a hollow stringed musical instrument or part thereof comprising:

laying one or more pieces of fiber cloth into each of a top mold and a bottom mold, said top and bottom molds shaped to form respectively the top and bottom halves of the hollow stringed musical instrument or part thereof, where the cloth pieces are sized so that cloth extends beyond the edges of the top and bottom molds, and where the cloth pieces are optionally impregnated with a heat-curable resin;

adding heat-curable resin as needed to the cloth in an amount sufficient to fully saturate the cloth;

mating the top and bottom molds;

curing the heat-curable resin by a vacuum molding process; and coating an interior surface of the hollow stringed musical instrument or part thereof with a non-foam elastomeric continuous sound-damping coating to form a continuous sound-damping layer and separate the resin matrix fiber reinforced composite from the interior space.

19. A process according to claim 18, wherein the resin matrix is selected from the group consisting of epoxy, polyester, vinylester, or phenolic resins and the reinforcing fibers are selected from carbon, boron, silicon carbide, and tungsten fibers.

20. A process according to claim 18, further comprising laying one or more pieces of fiber cloth into each of a top mold and a bottom mold, where one or more pieces of fiber cloth contain glass fibers.

21. A process according to claim 18, wherein the carbon-fiber-containing cloth and glass-fiber-containing cloth are laid in the molds in 2 to 20 layers.

22. A process according to claim 21, wherein the carbon-fiber-containing cloth and glass-fiber-containing cloth are laid in the molds in alternating layers.

23. A process according to claim 18, wherein the hollow stringed musical instrument or part thereof is a neck part.

24. A process according to claim 18, wherein the instrument includes a neck and arched frets, each arched fret defining a space between the arched area and a surface of the neck and attached to said surface by a bead of adhesive applied in said space.

25. A process for producing a fiber-reinforced composite hollow stringed musical instrument or part thereof comprising the steps of:

molding a hollow stringed musical instrument or part thereof of a resin matrix fiber reinforced composite material;

bonding a non-foam elastomeric continuous sound-damping layer to all or a portion of an interior surface of the hollow stringed musical instrument or part thereof to form a continuous sound-damping layer and separate the resin matrix fiber reinforced composite from the interior space.

26. A process according to claim 25, wherein the molding step includes a heat curing step, and the heat curing step bonds a non-foam elastomeric sound-damping layer to all or a portion of an interior surface of the hollow stringed musical instrument or part thereof.

27. A process for manufacturing a fiber reinforced composite hollow stringed instrument or part thereof, including disposing precursor material therefor in a mold having an inflatable polymeric balloon therein, inflating the balloon to dispose the precursor material against interior wall surface (s) of the mold, and heat curing the precursor material.

* * * * *